United States Patent [19]

Hirano et al.

[11] 4,156,239

[45] May 22, 1979

[54] DISPLAY DEVICE

[75] Inventors: Reiji Hirano, Yokohama; Mitsuaki Seki; Yukinobu Suwa, both of Tokyo, all of Japan

[73] Assignee: Canon Kabushiki Kaisha, Tokyo, Japan

[21] Appl. No.: 813,698

[22] Filed: Jul. 7, 1977

[30] Foreign Application Priority Data

Jul. 16, 1976 [JP] Japan ..... 51-84783
Jul. 16, 1976 [JP] Japan ..... 51-84784

[51] Int. Cl.[2] ..... H01J 17/48

[52] U.S. Cl. ..... 340/758; 313/190; 313/496; 313/519

[58] Field of Search ..... 313/190, 492, 496, 510, 313/519; 340/324 R, 336, 343, 337

[56] References Cited

U.S. PATENT DOCUMENTS

| | | | |
|---|---|---|---|
| 3,666,981 | 5/1972 | Lay | 313/190 |
| 3,780,326 | 12/1973 | Raago | 313/496 |
| 3,849,694 | 11/1974 | Harvey et al. | 313/519 |
| 3,868,535 | 2/1975 | Kupsky | 313/190 X |
| 3,903,448 | 9/1975 | Kuchinsky et al. | 13/519 |
| 4,047,072 | 9/1977 | Kishino et al. | 313/496 |
| 4,047,073 | 9/1977 | Kishino | 313/519 X |

*Primary Examiner*—David L. Trafton
*Attorney, Agent, or Firm*—Fitzpatrick, Cella, Harper & Scinto

[57] ABSTRACT

A display device especially adapted for use in pocket-sized electronic calculators has upper and lower display stages for simultaneously displaying operands. In one form shielding device is provided in order to avoid the interference between the upper and lower display stages. In addition, a variety of intraconnections among the segments, grids and cathode filaments ensures the uniformity of display brightness among the digits.

23 Claims, 22 Drawing Figures

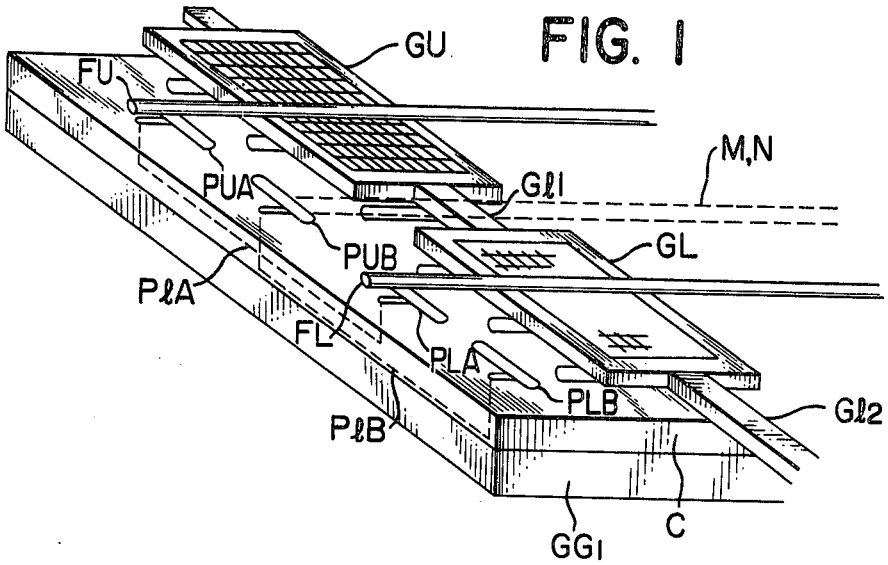
FIG. 1
FIG. 2A
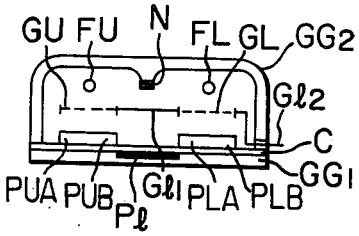
FIG. 2B
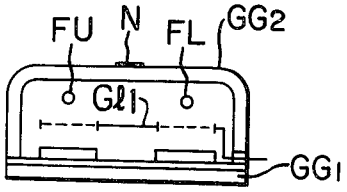
FIG. 2C
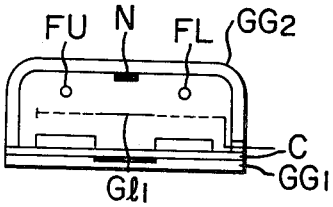
FIG. 2D
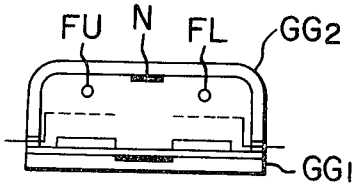
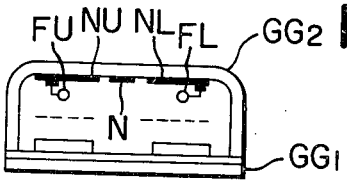
FIG. 2E

DISPLAY DEVICE

BACKGROUND OF THE INVENTION

1. Field of the Invention

The present invention relates to generally a display device and more particularly a display device which has upper and lower numeral display stages for simultaneously displaying operands and is especially adapted for use in pocket-sized electronic calculators.

2. Description of the Prior Art

The conventional pocket-sized electronic calculators having functions, such as four fundamental arithmetical rules, cannot simultaneously display operands and a result. That is, the operands and result are displayed individually. Therefore there has been an increasing demand among users for a display device which can simultaneously display operands so that one may visually confirm that a result is derived from the arithmetic operation of the operands that he entered.

SUMMARY OF THE INVENTION

In view of the above, one of the objects of the present invention is to provide a display device which can simultaneously display two numeric data.

Another object of the present invention is to provide a display device of the type described which is compact in size, simple in construction yet very reliable in operation.

A further object of the present invention is to provide a display device of the type described which may substantially avoid mis-display and variation in display brightness especially when its display units are enclosed within a common tube or envelope.

To this end, the present invention provides a display device comprising an upper numeral display stage consisting of a plurality of display units each having one displaying position of digits, a lower numeral display stage consisting of a plurality of display units, enclosure means for enclosing the upper and lower numeral display stages, and shielding means disposed between the upper and lower numeral display stages for avoiding the interference between them.

According to one embodiment, intraconnections among display segments, cathode filaments and grids are such that the variation in display brightness from one digit to another may be avoided.

The present invention will become more apparent from the following description of the preferred embodiments thereof taken in conjunction with the accompanying drawings.

BRIEF DESCRIPTION OF THE DRAWINGS

FIG. 1 is a perspective view of a display device in accordance with the present invention;

FIGS. 2A through 2E, FIGS. 3A and 3B and FIGS. 4A and 4B are sectional views showing various embodiments of the present invention;

DESCRIPTION OF THE PREFERRED EMBODIMENTS

In FIG. 1 there is shown a two-stage display device of the type disclosed in detail in Japanese Patent Laid Open Nos. 35234/1976 and 35299/1976. Disposed on a base C are numeral display segments PUA, PUB and so on in an upper display stage and similar display segments PLA, PLB and so on in a lower display stage. In this embodiment, these display segments PUA, PUB, PLA, PLB and so on are coated with fluorescent material. Disposed above these segments are an upper grid GU, a lower grid GL, an upper filament FU and a lower filament FL. The upper and lower grids GU and FL are interconnected with a lead wire $Gl_1$ and are simultaneously driven by a signal transmitted through a common lead wire $Gl_2$. The corresponding pairs of segments PUA and PLA; PUB and PLB and so on are interconnected with each other through lead wires PlA, PlB and so on extending over the undersurface of the base C so that each pair may be simultaneously driven. It is preferable that the segments PUA, PUB, PLA, PLB and so on in the upper and lower display stages are correctly selected and driven even in the dynamic drive, but in practice electrons tend to flow from the upper filament FU to the segments PLA, PLB and so on in the lower display stage so that the mis-display results.

In order to solve this problem, the present invention provides various arrangements to be described below. First, as shown in FIG. 2A a glass tube or cover GG2 is provided with a longitudinal ridge which is extended downwardly along the boundary between the upper and lower display stages, and a transparent, electrically conductive member N is attached to the lower end of the ridge and is normally biased to a negative potential so that the flow of electrons from the upper filament FU to the segments PLA, PLB and so on in the lower display stage may be prevented.

In an arrangement shown in FIG. 2B, a transparent, electrically conductive member N is placed over the glass tube GG2 along the boundary between the upper and lower display stages. Alternatively, the transparent electrically conductive member N may be placed over the undersurface of the glass tube GG2 along the boundary between the upper and lower display stages as shown in FIG. 2C or 2D. In an arrangement shown in FIG. 2E, in addition to the conductive member N transparent electrically conductive members NU and NL are placed over the interior surface of the glass tube GG2 in opposed relation with the display units in the upper and lower display stages and are electrically connected to the upper and lower filaments FU and FL, respectively, so that the adverse effect on display due to the electrostatic effect caused when an operator touches the glass tube GG2 with his finger may be avoided. It is preferable that the transparent, electrically conductive member N is biased more negatively than the upper and lower transparent, electrically conductive members NU and NL.

Figure 3A:
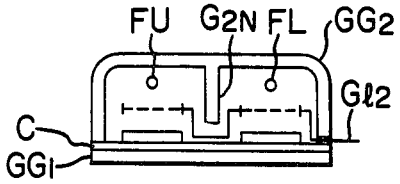
Figure 3B:
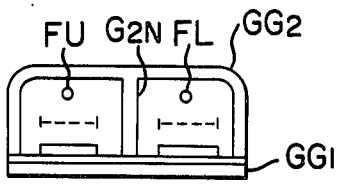

Instead of the electrical shielding means of the types described above, mechanical shielding means may be also employed as shown in FIGS. 3A and 3B. That is, the upper and lower display stages are partially or completely separated from each other by a partition wall G2N.

Figure 4A:
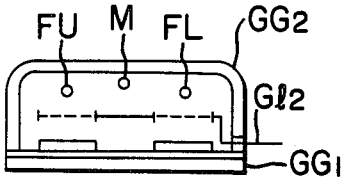
Figure 4B:
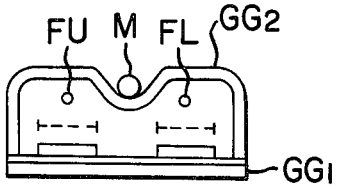

In FIG. 4A, a length of metal wire M is extended instead of the transparent, electrically conductive member N and is negatively biased, and in FIG. 4B the glass tube GG2 is formed with a longitudinal recess semi-circular in cross section and extended substantially along the boundary between the upper and lower display stages, and the metal wire M is placed in this recess and is positively biased so that the negative charges may be induced on the interior surface of the glass tube GG2 in opposed relationship with the metal wire M. It is preferable to use this wire M as a line used in the following display:

$$\begin{array}{r} 123 \\ \times\ 45 \\ \hline 5535 \end{array}$$

In FIGS. 2A and 2C, both grids and segments in the upper and lower display stages are interconnected with each other; in FIGS. 2B, 3A and 4A, the segments in the upper and lower display stages are not interconnected with each other while the grids are interconnected with each other; in FIG. 2D the segments in the upper display and lower display stages are interconnected with each other while the grids are not interconnected or are driven independently of each other; and in FIGS. 2E, 3B and 4B, the segments and grids in the upper and lower display stages are not interconnected with each other or are driven independently of each other.

The electrical shielding arrangement with the conductive members NU and NL shown in FIG. 2E may be equally employed in other segment and grid arrangements and especially in the arrangements shown in FIGS. 2B, 3A and 4A (wherein the segments in the upper and lower display stages are driven independently while the grids are interconnected with each other) because the variation in display illumination may be avoided and consequently the numerals displayed in the upper and lower display stages may be uniformly illuminated or glow. In addition to the luminescent-type display device described above, the present invention may be equally employed in other types of display devices employing liquid-crystal, electroluminescence, electrochromy or the like. The segments in both upper and lower display stages may be correctly selected and positively driven to appear in color, and the display of undesired data and the variation in display illumination may be avoided. In addition, the numerals may be displayed with sharp contrast against their background.

Figure 5:
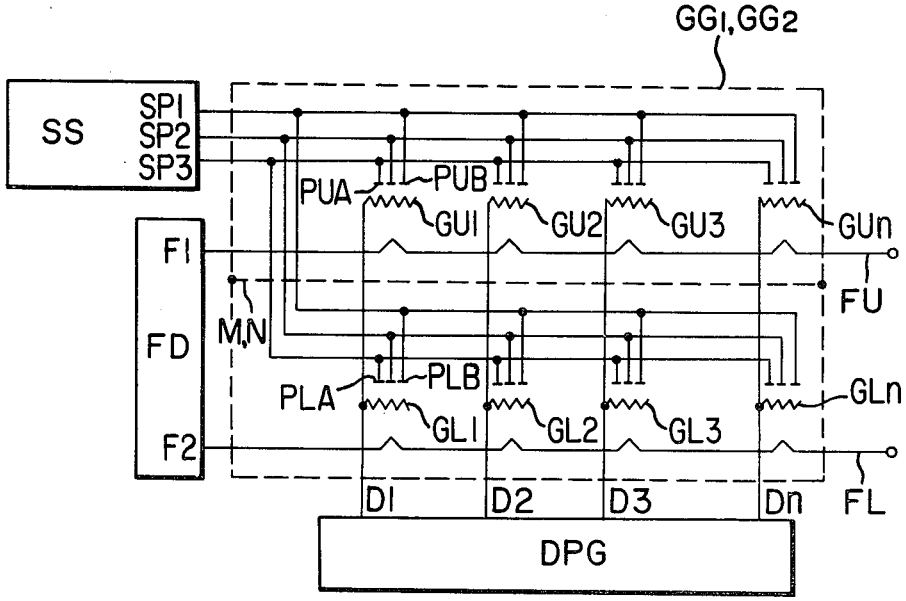
FIGS. 5, 6 and 7 are schematic diagrams of electrical circuits of the display devices shown in FIGS. 2A through 4B.

In FIG. 5 there is shown a driver circuit adapted for driving the display device of the types shown in FIGS. 2A and 2C. A digital pulse generator or digit-driver DPG generates digit position pulses D1 through Dn, and cooperates with a filament driver FD and a segment driver SS for dynamically driving the display units. In order to display the numerals in the upper or lower display stage, the filament driver FD conducts the current through the upper filament FU or lower filament FL by selecting an upper filament drive signal F1 or a lower filament drive signal F2.

Figure 6:
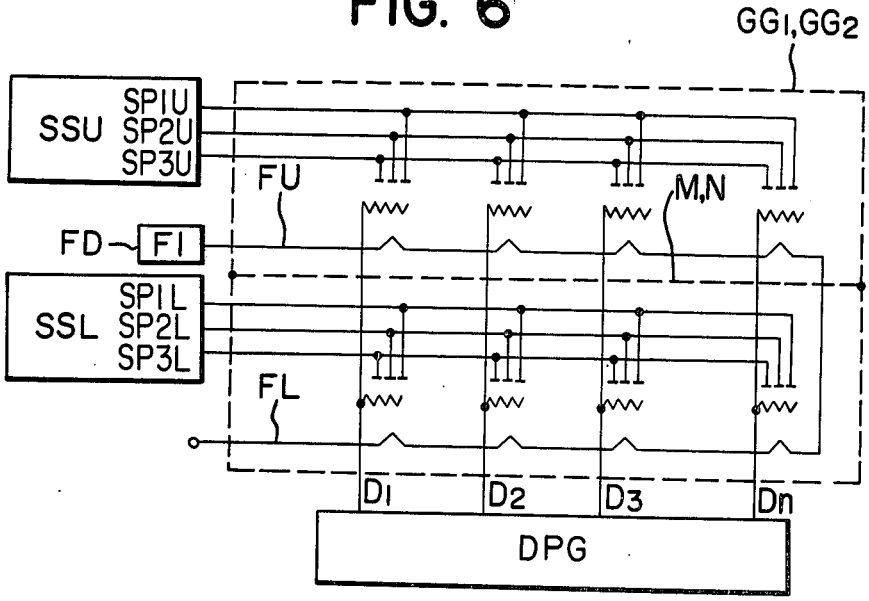

In FIG. 6 there is shown a driver circuit adapted to drive the display units of the type shown in FIGS. 2B, 3A and 4A. The numerals are displayed in the upper or lower display stage in response to drive signals SP1U through SP3U from an upper segment driver SSU or drive signals SP1L through SP3L from a lower segment driver SSL.

Figure 7:
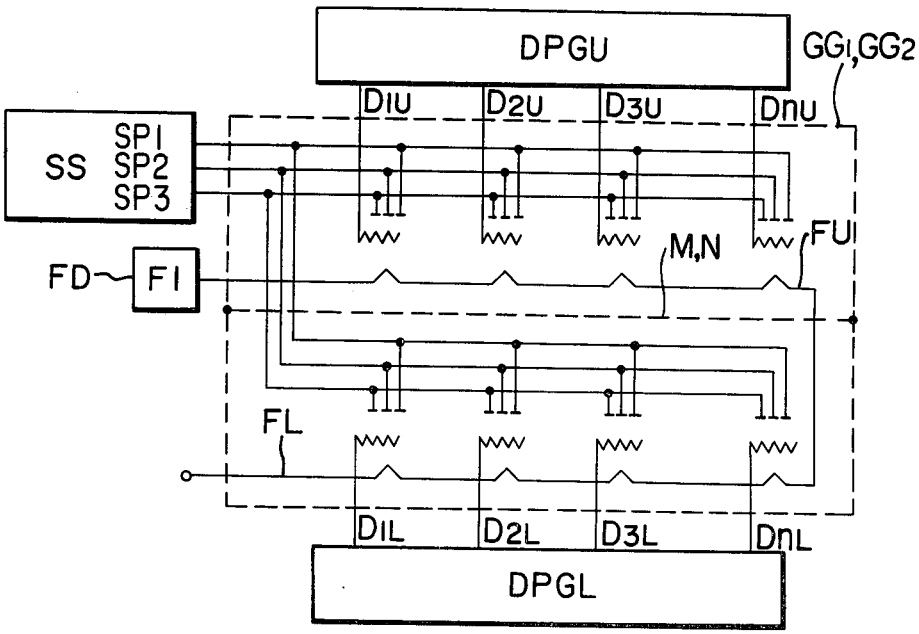

In FIG. 7 there is shown a driver circuit adapted for driving the display unit of the type shown in FIG. 2. The numerals are displayed in the upper or lower display stage in response to drive signals D1U through DnU from an upper-stage digit pulse generator DPGU or the drive signals D1L through DnL from a lower-stage digit pulse generator or digit driver DPGL.

The driver circuit shown in FIG. 5 is most preferable because the number of input terminals to the glass tubes GG1 and GG2 is minimum.

Next, the mode of operation of the display device in accordance with the present invention will be described in more detail with reference to FIG. 8. The display units DV1 through DV8 are of the type described, and the display units DV1 through DV4 are used to display one data (or a first operand) while the display units DV5 through DV8 are used to display another data (or a second operand). Cathode filaments KF1 through KF8 which, upon energization, emit thermal electrons, are connected in series, and a filament power source KFP is connected to terminals FV1 and FV2. The display units DV1 through DV8 are provided with independent grids G1 through G8, respectively, which in turn are connected to terminals GT1 through GT8 to which are applied grid drive signals from CDT1 through CDT8.

Figure 9:
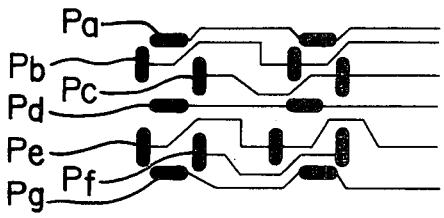
FIG. 9 shows a seven-segment or -bar pattern used in the display device in accordance with the present invention.

As shown in FIG. 9, each of the plates P1 through P8 consists of seven segments Pa through Pg, and the corresponding segments in the display units DV1 through DV8 are interconnected with each other. Segment drive signals are applied to terminals PaT through PcT.

Since the filaments, grids and segments are electrically connected in the manner described in a display tube, the number of terminals for connection with external drive circuits can be considerably reduced so that the assembly may be much facilitated.

In response to a numeral display signal from a main chip of a calculator (not shown), a segment driver SD generates the segment drive signals. A first digit driver DD1 generates the digit drive signals for the display units DV1 through DV4 while a second digit driver DD2 generates the drive signals for the display units DV5 through DV8.

Figure 10:
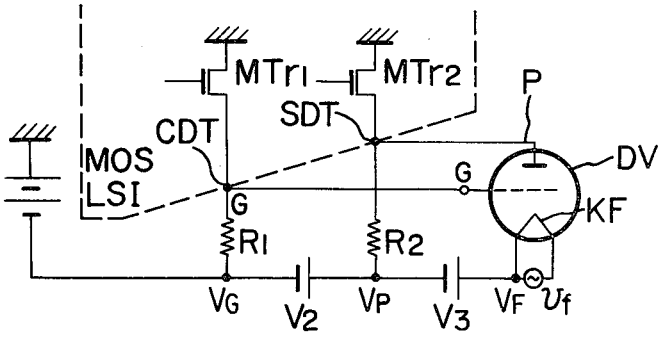
FIG. 10 is a detailed circuit diagram of a drive circuit of the display device shown in FIG. 8.

More particularly, each of the display units DV1 through DV8 is connected to the segment driver SD and the first and second digit drivers DD1 and DD2 as shown in FIG. 10. The negative terminal of a first power source V1 is connected through a first resistor R1 to a digit drive signal output terminal CDT of the first or second digit driver DD1 or DD2, and the terminal CDT is connected to the grid G of the display unit DV. When the digit drive signal is impressed on a MOS transistor MTr1, the grid potential drops to zero, and when the transistor MTr1 is disabled, the output voltage from the first power source V1 is impressed through the first resistor R1 on the grid G.

A second power source V2 is connected in series but in antiparallel relationship with the first power source V1, and the positive terminal of the second power source V2 is connected through a second resistor R2 to an output terminal SDT of the segment driver SD which in turn is connected to the plate P of the display unit DV. When the segment drive signal is applied to a MOS transistor MTr2, the plate potential drops to zero, but when the transistor MTr2 is disabled, a potential equal to the difference between the voltages of the first and second power sources V1 and V2 (that is, the potential equal to V1−V2) is impressed on the plate P.

A third power source V3 is connected in series in the same direction with the second power source V2, and the positive terminal of the third power source V3 is connected to the cathode filament F of the display unit DV which is energized by a fourth power source Vf.

In operation, the display information is applied to the segment driver SD digit by digit, and in synchronism with this the first digit driver DD1 generates the digit drive signals sequentially on the output terminals CDT1 through CDT4 and hence the drive signals are applied sequentially to the grids G1 through G4.

When both the segment and digit drive signals are applied to the grid G and the plate P, both the plate and grid potentials drop to zero and becomes more positive with respect to the cathode filament KF so that the terminal ions emitted therefrom strike against the plate P to excite the selected segments and consequently the desired numeral or symbol is displayed. After the display units DV1 through DV4 have been lighted sequentially in the manner described above, the signals representative of the numerals by the display units DV5 through DV8 are applied to the segment driver SD and the second digit driver DD2 generates the digit signals sequentially so that the numerals are displayed by the display units DV5 through DV8.

The first group of display units DV1 through DV4 and the second group of display units DV5 through DV8 are alternately driven so that two data (for instance, a first operand and a second operand) may be simultaneously displayed.

The second and third power sources V2 and V3 are provided in order to reverse biase between the cathode filament KF and the grid G to stop the display when the transistors MTr1 and Mtr2 are disabled. The plate P is of course reverse biased with respect to the cathode filament KF.

So far four display units have been used for displaying one data, but the pocket-size or desktop electronic calculators now available in the market are in general of the eight-digit type. Therefore the display device having the 8-digit upper and lower display stages in accordance with the present invention is incorporated in an electronic calculator, the display duty (or the power available for the display device) becomes one half as compared with the conventional pocket-size electronic calculators having a single 8-digit display device. That is, the display brightness is decreased. In order to solve this problem, the power source voltage must be increased, but in practice the increase in power source voltage is limited because of the breakdown voltage of a MOSLSI including a segment driver, a digit driver and other electronic circuits. Therefore one solution is to provide a drive circuit which may impress a high voltage on the display units in response to the signal from a master chip or LSI as will be described in detail with reference to FIG. 11.

Figure 11:
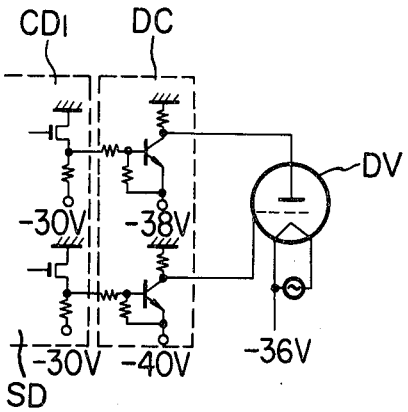
FIG. 11 is a schematic diagram of a drive circuit for improving the display brightness.

In FIG. 11 a drive circuit DC is interconnected between the display unit DV and the segment driver and the first or second digit driver. The display unit DV can be driven at a higher potential so that the decrease in display brightness may be avoided.

Figure 8:
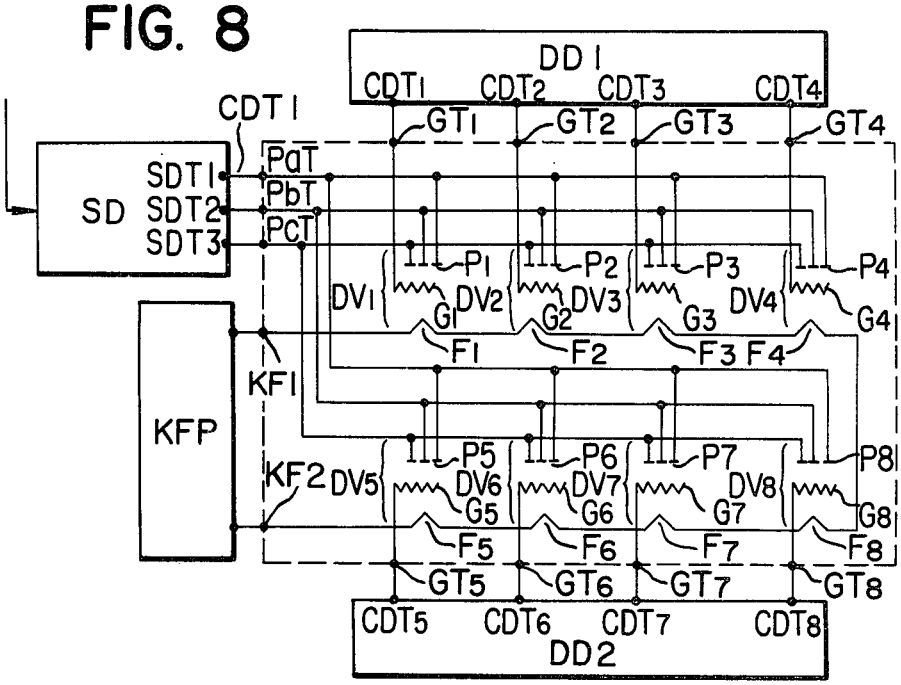
FIG. 8 is a circuit diagram of a display device in accordance with the present invention.
Figure 12:
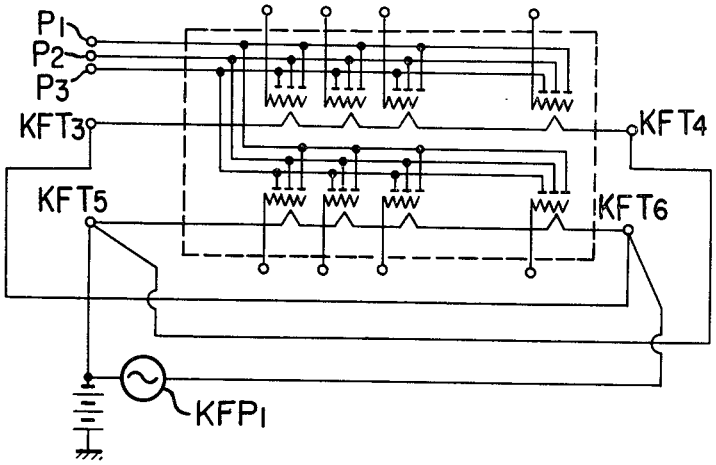
FIGS. 12 and 13 are circuit diagrams of modifications, respectively, of the display device shown in FIG. 8 for improving the display brightness.

In FIG. 12 there is shown a modification of the display device shown in FIG. 8. The display units DV1 through DV8 are enclosed within a common tube or envelope, and the cathode filaments of each group are connected in series and also connected to terminals KFT3 and KFT4 or KFT5 and KFT6 for connection with an external filament power source. As a result, the variation in cathode potential with respect to the plate or grid potential may be minimized and consequently the variation in display brightness may be avoided. Furthermore in order to further minimize the variation in display brightness, the terminal KFT3 is connected to the terminal KFT6 while the terminals KFT4 and KFT5 are interconnected, and the filament power source KFP1 is interconnected between the junction points. As a result, the cathode potential with respect to the plate potential decreases in the order of the display units DV5, DV6 and so on and in the order of the display units DV4, DV3 and so on. Therefore the display brightness of the display units DV1 and DV5, the display brightness of the display units DV2 and DV6 and so on are averaged and consequently the display brightness in the right and left digits is also averaged. In addition, the spacing between the filament and the plate P may be varied in each display unit DV so that the display brightness becomes uniform.

Figure 13:
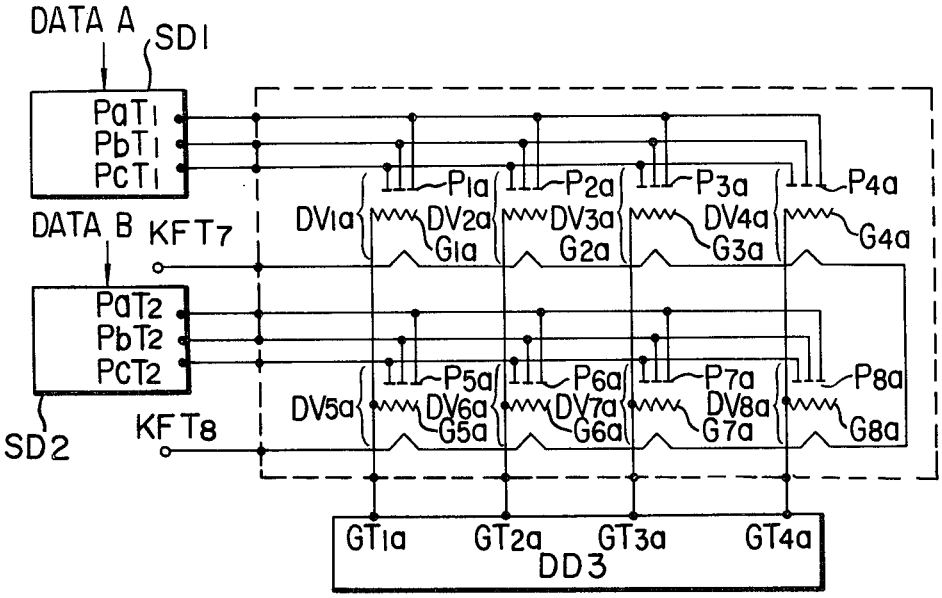

In FIG. 13 there is shown another modification of the display device shown in FIG. 8 for avoiding the decrease in display brightness. A first segment driver SD1 generates the segment drive signals for the display units DV1*a* through DV4*a* while a second segment driver SD2 generates the segment drive signals for the display units DV5*a* through DV8*a*. A digit driver DD3 generates the digit drive signals for all of the display units DV1*a* through DV8*a*.

In the first or upper group of display units DV1*a* through DV4*a*, the corresponding segments of the plates P1*a* through P4*a* are interconnected, and same is true for the second or lower group of display units DV5*a* through DV8*a*. Respective segment groups thus interconnected are connected to output terminals PaT1, PbT1 and PcT1 of the first segment driver SD1 and to output terminal PaT2, PbT2 and PcT2 of the second segment driver SD2.

The grids G1*a* and G5*a* are interconnected with each other and connected to an output terminal GT1*a* of the digit driver; the grids G2*a* and G6*a* are interconnected with each other and connected to an output terminal GT2*a*; and the grids G3*a* and G7*a* and the grids G4*a* and G8*a* are connected in like manner to output terminals GT3*a* and GT4*a*, respectively.

With the above interconnection among the display units DV1*a* through DV8*a*, the display duty cycle can be doubled as compared with the connection shown in FIG. 8, and a drive circuit can be eliminated. Therefore one-chip pocket-size electronic calculators are feasible.

Figure 14:
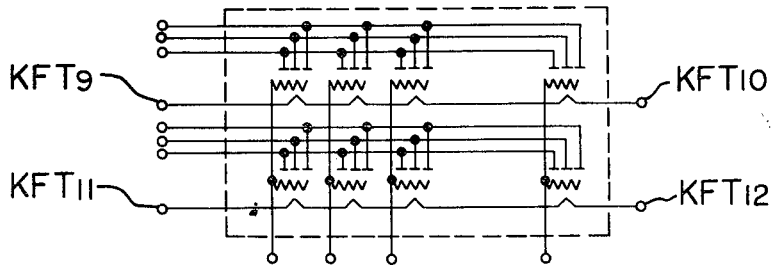
FIG. 14 is a circuit diagram of a further modification of the display device shown in FIG. 8.

In the modification shown in FIG. 13, the cathodes are connected in series and connected to the terminals KFT7 and KFT8 for connection with an external cathode power source (not shown), but as shown in FIG. 14 the filaments of the upper group of display units DV are connected in series and to terminals KFT9 and KFT10 for connection with an external filament power source while the filaments of the lower group of display units DV are also connected in series and to terminals KFT11 and KFT12 for connection with the external filament power source. Therefore the same effects obtained with the arrangement shown in FIG. 12 can be attained.

With the connection arrangements shown in FIGS. 13 and 14, each of the display units may be encased within a glass tube or the like and they may be three-dimensionally interconnected with each other through conductors formed on a printed circuit board or the like.

Figure 15:
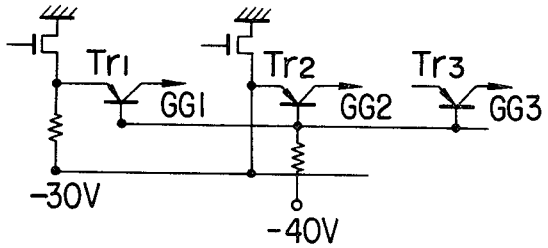
FIG. 15 is a schematic diagram of a digit driver.

In FIG. 15 there is shown an example of the digit driver wherein the bases of transistors Tr1 through Tr3 which impress voltage on the grids GG1 through GG3 are connected to a common base resistor so that a number of resistors may be reduced and consequently a space for the resistors on a chip may be decreased. Thus, the chip may be reduced in size.

Figure 16:
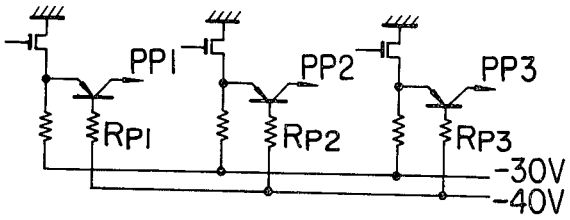
FIG. 16 is a circuit diagram of a segment driver.

In FIG. 16 there is shown a segment driver best adapted for use in the display device shown in FIG. 13 and having a higher display duty. Transistors for applying potentials to the plates PP1 through PP3 have their bases connected to independent base resistors Rp1 through Rp3, respectively.

What we claim is:

1. A display device comprising:
first numerical display means;
second numerical display means disposed in parallel with said first numerical display means; and
an enclosure having a window plate for enclosing said first and second numerical display means under said window plate, said window plate including a projection which extends downwardly along a border between said first and second numerical display means to prevent said first and second numerical display means from interfering with each other.

2. A display device in accordance with claim 1, further comprising a transparent electrode disposed upon said projection for electrostatically shielding said first and second numerical display means from each other.

3. A display device in accordance with claim 1, wherein said projection partitions the interior of said enclosure into at least two parts.

4. A display device in accordance with claim 1, wherein said window plate is provided with a recess on the outer surface thereof along the border between said first and second numerical display means, said display device further comprising a conductor disposed in said recess for preventing said first and second numerical display means from interfering with each other.

5. A display device in accordance with claim 1, wherein each of said numerical display means includes a group of parallel display units.

6. A display device comprising:
first numerical display means;
second numerical display means disposed in parallel with said first numerical display means; and
an enclosure having a window plate for enclosing said first and second numerical display means under said window plate, said window plate including a projection, formed of the same material as said window plate, which extends downwardly along a border between said first and second numerical display means to prevent said first and second numerical display means from interfering with each other.

7. A display device in accordance with claim 6, further comprising a transparent electrode disposed upon said projection for electrostatically shielding said first and second numerical display means from each other.

8. A display device in accordance with claim 6, wherein said projection partitions the interior of said enclosure into at least two parts.

9. A display device in accordance with claim 6, wherein said window plate is provided with a recess on the outer surface thereof along the border between said first and second numerical display means, said display device further comprising a conductor disposed in said recess for preventing said first and second numerical display means from interfering with each other.

10. A display device in accordance with claim 6, wherein each of said numerical display means includes a group of parallel display units.

11. A display device comprising:
an enclosure having a viewing window;
first groups of display electrodes arranged side by side along said viewing window to form side-by-side character positions;
first grid electrodes disposed to face said respective first groups of display electrodes;
a first cathode disposed over said first grid electrodes;
second groups of display electrodes arranged in parallel with said first groups of display electrodes and side-by-side along said viewing window to form side-by-side character positions;
second grid electrodes disposed to face said respective second groups of display electrodes;
a second cathode disposed over said second grid electrodes;
means for applying signals for selection of the display electrodes of said first and second groups of display electrodes;
means for selectively driving said first and second grid electrodes; and
means for alternatively driving either one of said first and second cathodes.

12. A display device in accordance with claim 11, wherein said first and second cathodes are disposed parallel with each other and each has two end portions, and wherein the corresponding end portions of each cathode are cross-connected to the opposite end portions of the other cathode.

13. A display device in accordance with claim 11, wherein said viewing window includes a projection extending downwardly between said first and second groups of display electrodes.

14. A display device in accordance with claim 13, wherein said projection comprises a transparent electrode for electrostatically shielding said first and second groups of display electrodes from each other.

15. A display device in accordance with claim 11, wherein the spacing of said first groups of display electrodes with respect to said first cathode is different between said first groups of display electrodes.

16. A display device comprising:
an enclosure having a viewing window;
first groups of display electrodes arranged side-by-side along said viewing window to form side-by-side character positions;
first grid electrodes disposed facing said respective first groups of display electrodes;
a first cathode disposed over said first grid electrodes;
second groups of display electrodes arranged in parallel with said first groups of display electrodes and side-by-side along said viewing window to form side-by-side character positions;
second grid electrodes disposed facing said respective second groups of display electrodes;

a second cathode disposed over said second grid electrodes and connected to said first cathode;

first selection means for applying signals for selection of the display electrodes of said first groups of display electrodes;

second selection means for applying signals for selection of the display electrodes of said second groups of display electrodes;

means for selectively driving said first and second grid electrodes; and means for selectively driving said first cathode.

17. A display device in accordance with claim 16, wherein said viewing window includes a projection extending downwardly between said first and second groups of display electrodes.

18. A display device in accordance with claim 17, wherein said projection comprises a transparent electrode for electrostatically shielding said first and second groups of display electrodes from each other.

19. A display device in accordance with claim 16, wherein the spacing of said first groups of display electrodes with respect to said first cathode is different between said first groups of display electrodes.

20. A display device comprising:

an enclosure having a viewing window;

first groups of display electrodes arranged side-by-side along said viewing window to form side-by-side character positions;

first grid electrodes disposed facing said respective first groups of display electrodes;

a first cathode disposed over said first grid electrodes;

second groups of display electrodes arranged in parallel with said first groups of display electrodes and side-by-side along said viewing window to form side-by-side character positions;

second grid electrodes disposed facing said respective second groups of display electrodes;

a second cathode connected to said first cathode and disposed over said second grid electrodes;

means for applying signals for selection of the display electrodes to said first and second groups of display electrodes;

first grid selection means for sequentially selecting said respective first grid electrodes;

second grid selection means for sequentially selecting said respective second grid electrodes; and means for selectively driving said first cathode and said second cathode connected to said first cathode.

21. A display device in accordance with claim 20, wherein said viewing window includes a projection extending downwardly between said first and second groups of display electrodes.

22. A display device in accordance with claim 21, wherein said projection comprises a transparent electrode for electrostatically shielding said first and second groups of display electrodes from each other.

23. A display device in accordance with claim 20, wherein the spacing of said first groups of display electrodes with respect to said first cathode is different between said first groups of display electrodes.

* * * * *